US006417773B1

(12) United States Patent
Vlahos et al.

(10) Patent No.: US 6,417,773 B1
(45) Date of Patent: Jul. 9, 2002

(54) SOUND-ACTUATED SYSTEM FOR ENCOURAGING GOOD PERSONAL HYGIENE IN TOILET FACILITIES

(76) Inventors: Gust N. Vlahos, 10521 Preston St., Westchester, IL (US) 60154; Robert B. Jones, 842 Willam St., River Forest, IL (US) 60305

( * ) Notice: Subject to any disclaimer, the term of this patent is extended or adjusted under 35 U.S.C. 154(b) by 0 days.

(21) Appl. No.: 09/886,884

(22) Filed: Jun. 21, 2001

(51) Int. Cl.[7] ..... G08B 23/00

(52) U.S. Cl. ..... 340/573.1; 340/522; 340/692; 340/691.5; 340/603

(58) Field of Search ..... 340/573.1, 522, 340/692, 691.5, 603; 4/406, 432, 300, 301, 302, 303

(56) References Cited

U.S. PATENT DOCUMENTS

| | | | | |
|---|---|---|---|---|
| 5,134,796 A | | 8/1992 | Satoh et al. | 40/414 |
| 5,209,695 A | | 5/1993 | Rothschild | 446/175 |
| 5,407,376 A | | 4/1995 | Avital et al. | 446/175 |
| 5,493,618 A | * | 2/1996 | Stevens et al. | 381/110 |
| 5,647,787 A | | 7/1997 | Raviv et al. | 446/175 |
| 5,870,015 A | * | 2/1999 | Hinkel | 340/573 |
| 6,028,520 A | * | 2/2000 | Maehre | 340/573.1 |
| 6,038,711 A | | 3/2000 | Clarke | 4/449 |
| 6,282,732 B1 | * | 6/2000 | Krvavica et al. | 4/405 |

FOREIGN PATENT DOCUMENTS

| | | | |
|---|---|---|---|
| JP | 10-014823 | * | 6/1996 |

* cited by examiner

*Primary Examiner*—Jeffery Hofsass
*Assistant Examiner*—Daniel Previl
(74) *Attorney, Agent, or Firm*—Fitch, Even, Tabin & Flannery

(57) ABSTRACT

A system for encouraging good personal hygiene in toilet facilities is provided, including means for detecting the acoustic signal generated by the inrush of water into a toilet bowl to trigger a recorded admonition to the toilet user to cleanse his or her hands.

5 Claims, 1 Drawing Sheet

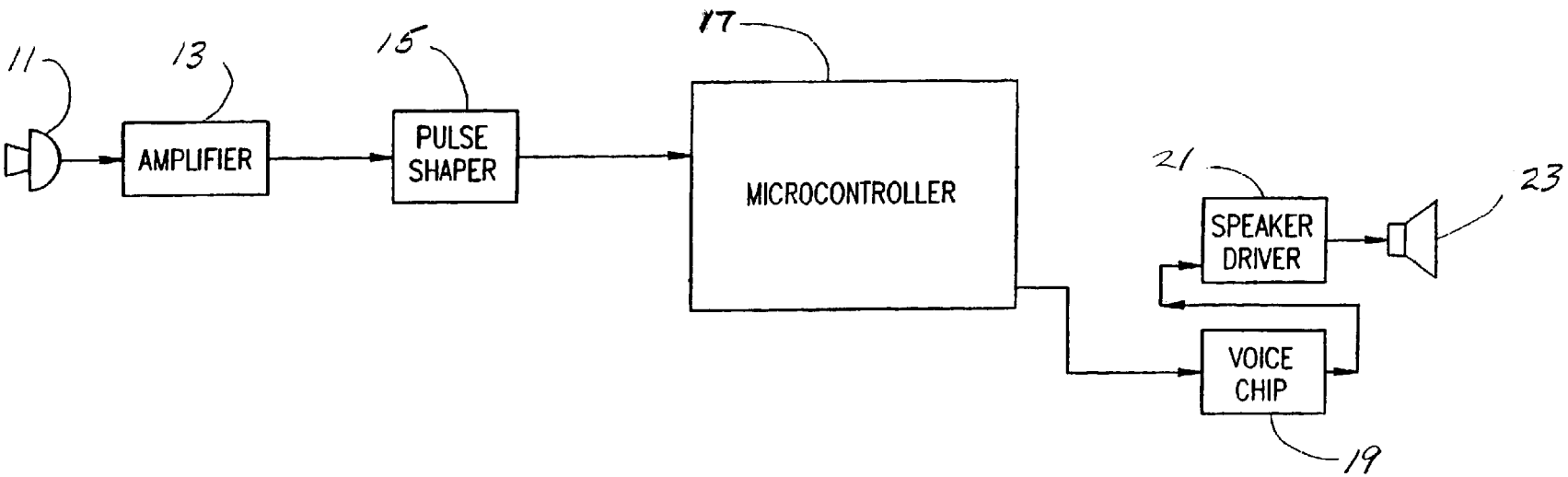
11
AMPLIFIER
13
PULSE SHAPER
15
MICROCONTROLLER
17
SPEAKER DRIVER
21
VOICE CHIP
19
23

SOUND-ACTUATED SYSTEM FOR ENCOURAGING GOOD PERSONAL HYGIENE IN TOILET FACILITIES

BACKGROUND OF THE INVENTION

The present invention relates generally to systems for improving sanitation in toilet facilities, and more particularly, for encouraging good personal hygiene by users of toilet facilities.

A pervasive cause of gastrointestinal illness is contamination of food by fecal microorganisms. A major source of such contamination is inadequate cleansing of the hands of food preparation personnel after the use of toilet facilities. Public health authorities regularly encourage institutional food service providers to admonish their employees to adhere to accepted sanitation procedures. In particular, food handlers are expected to thoroughly cleanse their hands after using the toilet. To achieve that end, training sessions and warning signs are used to educate employees about the dangers of inadequate cleansing, and to instill in them the habit of careful hand washing.

Similarly, in the home, children must be educated in the necessity of washing their hands to avoid the spread of gastrointestinal illness in the family. Having succeeded in toilet training their children, parents are then faced with the challenge of further educating them in personal cleanliness, something of which children are usually blissfully unaware. No matter how frequently children are cautioned about hand washing, they are often so anxious to return to their play that they forget about their parents' admonitions and rush to resume their activities, sans ablutions.

Solutions to these problems have been proposed, with marginal success. For example, U.S. Pat. No. 6,028,520 recites as one object to train children to wash their hands after using the toilet, accomplished by providing an annunciator triggered by a motion detector or a switch actuated by the toilet flush lever, whereupon a suitable recorded message is played admonishing the child to wash his or her hands. Such triggering means are less than satisfactory. In the case of a motion sensor, the annunciator is activated by motion not associated with toilet use, resulting in needless repetition of the message, and loss of effectiveness. In the case of a lever-actuated switch, the switch must be coupled to the lever, requiring mechanical modification of the toilet and unwanted expense.

It is therefore the principal object of the present invention to provide a system for automatically encouraging the practice of good hygiene in the use of toilet facilities, both by children and adults, in the furtherance of public health.

SUMMARY OF THE INVENTION

In accordance with the present invention, there is provided a system for encouraging the practice of good hygiene, wherein after use of a toilet the user is reminded by a recorded message to thoroughly cleanse his or her hands before leaving the toilet facility. The message is suitably tailored to fit the circumstances. For example, in the home, the message preferably is recorded by a parent, and also may be addressed by name to a particular child. In a restaurant, the message may be recorded by the restaurant manager, whose voice will be recognized by the restaurant employees and, presumably, made more authoritative. In both cases, a recorded message may be accorded greater credibility by the user, especially compared to the use of printed signs or notices posted in the vicinity.

These ends are achieved by the provision of a recorded message and an annunciator which are activated by the sound generated by the flow of water into the toilet bowl when the toilet is flushed. In general, the system of the present invention comprises a microphone positioned so as to intercept the sound generated by the flushing toilet, an amplifier, a controller, a voice chip or other audio storage means, and a speaker.

BRIEF DESCRIPTION OF THE DRAWING

The objects and advantages of the present invention will be apparent upon consideration of the following detailed description, taken in conjunction with the accompanying drawing comprising a block diagram of operational electronics employed in one embodiment of the present invention.

DETAILED DESCRIPTION OF THE INVENTION

In accordance with the present invention, and with reference to the drawing, there is provided a conventional microphone 11, which is disposed in a toilet facility at a location permitting reception of the sound generated by flushing of the toilet. Preferably, the microphone and the other components to be described are combined in a unit contained in a compact case for mounting on the ceiling of the toilet facility or at another location out of convenient reach by toilet users, to discourage tampering and vandalism. Desirably, a battery power supply is also provided in the unit so that the entire system may be installed merely by attaching it to the surface of the ceiling or wall, in much the same manner as in conventional battery-powered smoke detectors. Also desirably, if the unit is battery-powered, provision may be made for a low-battery alarm, again in the same manner as in conventional smoke detectors.

The audio signal detected by the microphone 11 is converted to an electrical signal which is fed to an amplifier 13. The amplified electrical signal may be filtered or, as illustrated in the drawing, modified by a pulse shaper 15, to isolate the characteristic time-frequency signature of a flushing toilet from extraneous noise. Suitable amplifiers include a Motorola MC14069UB.

The amplified and processed signal is fed to a microcontroller 17, such as a PIC16C56, commercially available from Microchip Technology, Inc. of Chandler, AZ. The microcontroller recognizes the time-frequency signature of a flushing toilet in the incoming signal and generates a signal to activate a voice chip 19. Encoded in the voice chip is a message which is transmitted to a speaker driver 21. The speaker driver powers a speaker 23, which delivers an audible announcement-urging the toilet user to wash his or her hands prior to leaving the toilet facility. Suitable voice chips include an ISD 1020A, commercially available from Information Storage Devices, Inc. of San Jose, Cailf.

The message encoded in the voice chip 19 may be pre-recorded, so that the system may be installed by the purchaser ready for immediate activation and use with a "canned" message. Additionally, and more desirably, the encoded message may be personalized by the purchaser by recording the message in the voice of a particular person, e.g., a parent or a restaurant manager.

Methods and apparatus for activating switches in response to acoustic signals are known to those skilled in the art, exemplified by U.S. Pat. Nos. 5,493,618 and 5,647,787. The disclosure of those patents are hereby incorporated in this specification as if specifically set forth herein.

It should be understood that the present invention is not limited to what has been particularly shown and described herein. Rather, the scope of the present invention is defined only by the following claims:

What is claimed is:

1. A system for encouraging toilet users to cleanse their hands after use comprising:

a microphone disposed in the toilet facility at a location permitting reception of the acoustic signal generated by flushing of the toilet and converting it to a first electrical signal, a microcontroller receiving said first electrical signal, said microcontroller being responsive to the time-frequency signature associated with said acoustic signal and generating a second electrical signal upon detection thereof, annunciator means responsive to said second electrical signal including audio recording means and a speaker generating an audible message, said audio recording means encoding a message urging the toilet user to cleanse his or her hands.

2. The system of claim 1 further comprising filter means wherein frequencies extraneous to said acoustic signal are excluded from said first electrical signal.

3. The system of claim 1 further comprising pulse shaping means wherein the time-frequency signature of said acoustic signal in said first electrical signal is enhanced.

4. The system of claim 1 wherein said audio recording means includes means for encoding a personalized message.

5. A method for encouraging toilet users to cleanse their hands after use, comprising the steps of:

detecting the acoustic signal generated by flushing of the toilet, converting said acoustic signal to a first electrical signal, detecting said first electrical signal, and converting it to a second electrical signal to energize an audio recording urging the toilet user to cleanse his or her hands.

* * * * *